US010577946B2

(12) United States Patent
Thomas et al.

(10) Patent No.: US 10,577,946 B2
(45) Date of Patent: Mar. 3, 2020

(54) BLADE

(71) Applicant: ANSALDO ENERGIA SWITZERLAND AG, Baden (CH)

(72) Inventors: Nicholas Thomas, Würenlos (CH); Stergios Goutianos, Baden (CH); Rudolf Kellerer, Waldshut-Tiengen (DE); Nils Ohlendorf, Killwangen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 295 days.

(21) Appl. No.: 15/483,716

(22) Filed: Apr. 10, 2017

(65) Prior Publication Data

US 2017/0292383 A1 Oct. 12, 2017

(30) Foreign Application Priority Data

Apr. 8, 2016 (EP) ..... 16164581

(51) Int. Cl.

| | |
|---|---|
| ***F01D 5/18*** | (2006.01) |
| ***F01D 5/30*** | (2006.01) |
| ***F01D 5/28*** | (2006.01) |
| ***F01D 5/14*** | (2006.01) |

(52) U.S. Cl.

CPC ..... *F01D 5/188* (2013.01); *F01D 5/18* (2013.01); *F01D 5/282* (2013.01); *F01D 5/284* (2013.01); *F01D 5/3084* (2013.01); *F01D 5/3092* (2013.01); *F01D 5/147* (2013.01); *F01D 5/189* (2013.01); *F01D 5/3007* (2013.01); *F05D 2220/321* (2013.01); *F05D 2300/6033* (2013.01)

(58) Field of Classification Search

CPC ..... F01D 5/188; F01D 5/284; F01D 5/3007; F01D 5/3092; F01D 5/189

See application file for complete search history.

(56) References Cited

U.S. PATENT DOCUMENTS

| | | | | |
|---|---|---|---|---|
| 3,317,988 | A * | 5/1967 | Endres | B23P 15/006 29/447 |
| 5,993,156 | A * | 11/1999 | Bailly | F01D 5/187 415/115 |
| 7,968,031 | B2 * | 6/2011 | Carper | C04B 35/565 264/251 |
| 8,475,695 | B2 * | 7/2013 | Carper | C04B 35/565 264/258 |
| 10,156,147 | B2 * | 12/2018 | Waite | F01D 5/189 |
| 2009/0090005 | A1 | 4/2009 | Carper et al. | |
| 2011/0215502 | A1 | 9/2011 | Carper et al. | |

(Continued)

FOREIGN PATENT DOCUMENTS

| | | |
|---|---|---|
| EP | 1 676 823 A1 | 7/2006 |
| WO | WO 2015/080781 A2 | 6/2015 |

OTHER PUBLICATIONS

International Search Report (PCT/ISA/210) dated Sep. 19, 2016, by the Japanese Patent Office as the International Searching Authority for International Application No. EP 16 16 4581.

*Primary Examiner* — Christopher S Bobish

(74) *Attorney, Agent, or Firm* — Buchanan Ingersoll & Rooney PC

(57) ABSTRACT

A blade includes an airfoil and a root having diverging walls. The diverging walls are made of a ceramic matrix composite material. A reinforcement element is provided between the diverging walls.

15 Claims, 4 Drawing Sheets

(56) References Cited

U.S. PATENT DOCUMENTS

| | | | | |
|---|---|---|---|---|
| 2011/0229337 | A1* | 9/2011 | Carper | B32B 18/00<br>416/241 B |
| 2012/0195766 | A1 | 8/2012 | Cohin et al. | |
| 2016/0222800 | A1* | 8/2016 | Kleinow | F01D 5/22 |
| 2017/0218768 | A1* | 8/2017 | Boeck | F01D 5/08 |

* cited by examiner

BLADE

PRIORITY CLAIM

This application claims priority from European Patent Application No. 16164581.7 filed on Apr. 8, 2016, the disclosure of which is incorporated by reference.

TECHNICAL FIELD

The present invention relates to a blade, in particular a blade of a gas turbine engine.

BACKGROUND

Gas turbine engines have a turbine where hot gas is expanded to gather mechanical work. Typically the turbine has a plurality of stages, each comprising vanes (which do not rotate) and blades (which rotate).

The blades have to withstand very severe conditions, due for example to the high centrifugal forces and the high temperature of the gas they are immersed in. The conditions are particularly severe for long blades, such as the blades of the last stages (e.g. third, fourth or subsequent stages) of the turbine, because of the particularly high centrifugal forces.

In order to provide blades able to withstand severe conditions, blades made of ceramic matrix composite material (CMC) have been proposed. CMC is a composite material having carbon or ceramic fibers and a ceramic matrix. US 2012/0 195 766 A1 discloses a blade of this kind.

In particular, in the following reference is made to blades whose root has a shell structure; a shell structure is to be understood as a hollow structure having walls made of CMC. The airfoil can have a shell structure as well or it can have a solid structure; the airfoil is advantageously made of CMC.

A problem with these kinds of blades is the connection of the blades to the rotor. In fact, due to the high stress during operation, there is the risk that the hollow structure of the root collapses.

SUMMARY

An aspect of the invention includes providing a blade with a reduced risk that, during operation, the root or portions thereof may collapse.

These and further aspects are attained by providing a blade in accordance with the accompanying claims.

BRIEF DESCRIPTION OF THE DRAWINGS

Further characteristics and advantages will be more apparent from the description of a preferred but non-exclusive embodiment of the blade, illustrated by way of non-limiting example in the accompanying drawings, in which.

DETAILED DESCRIPTION OF EXEMPLARY EMBODIMENTS

Figure 1:
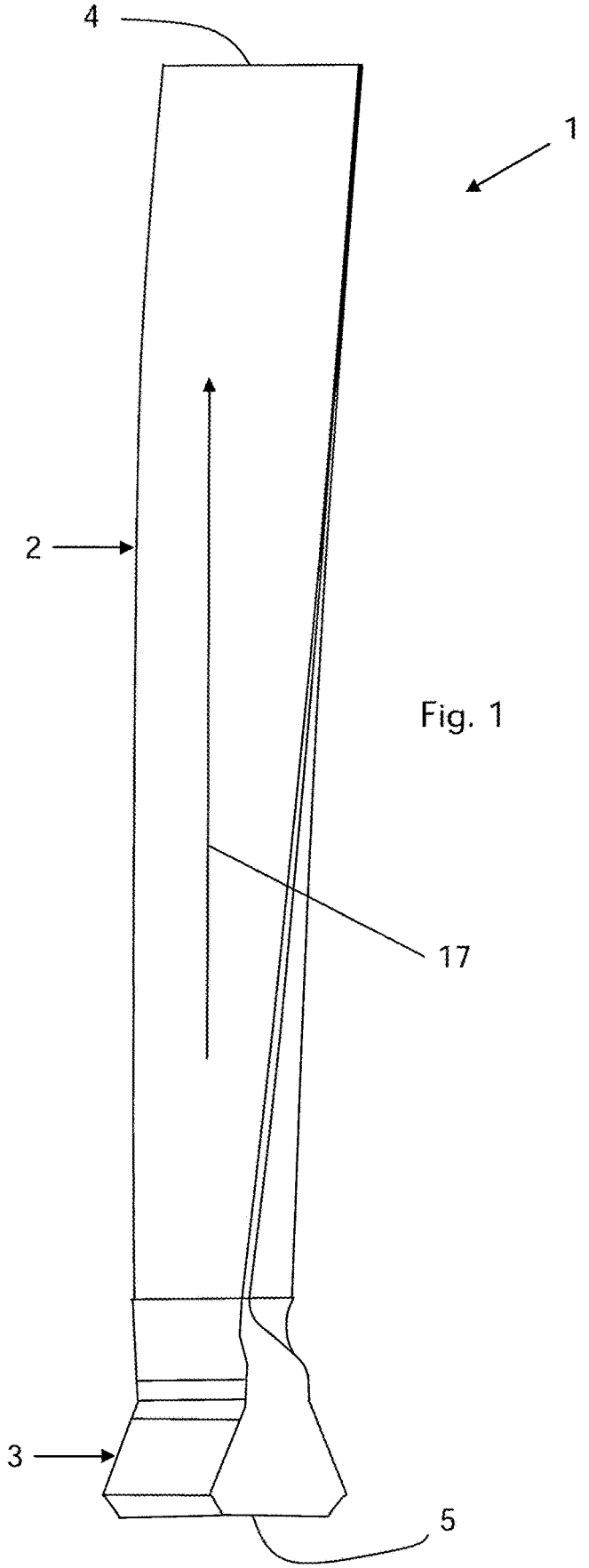
FIG. 1 shows a perspective view of a blade.
Figure 2:
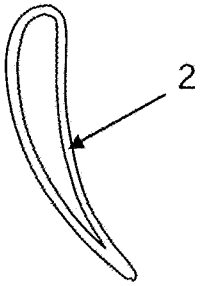
FIG. 2 shows a cross section of an airfoil of the blade.
Figure 3:
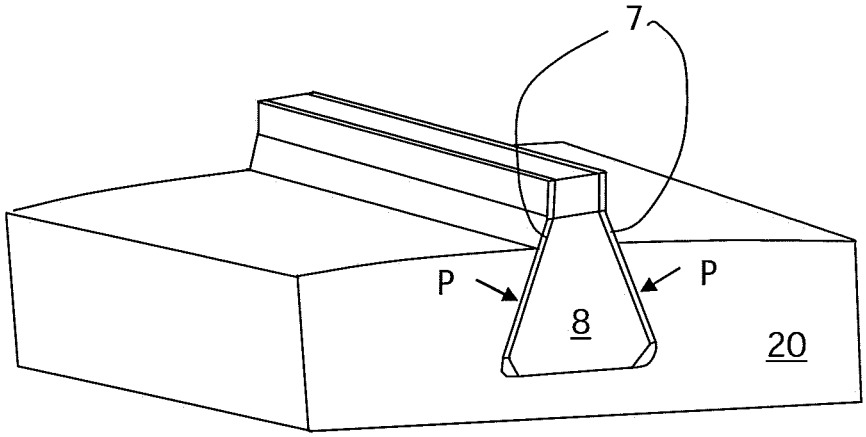
FIGS. 3 and 4 shows the root of the blade (FIG. 3) and an enlarged portion of the root (FIG. 4); in these figures a portion of the rotor is shown as well.
Figure 4:
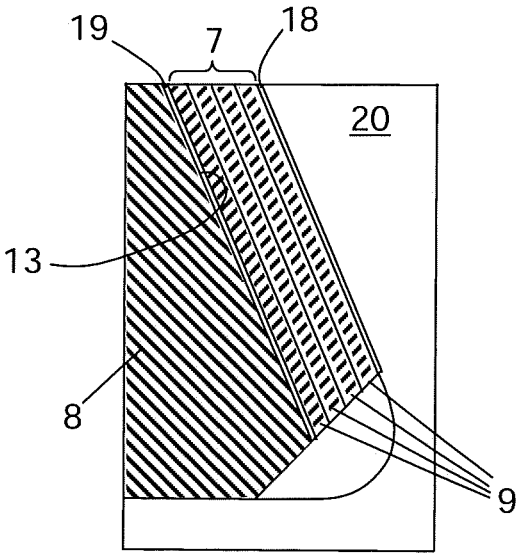
Figure 5:
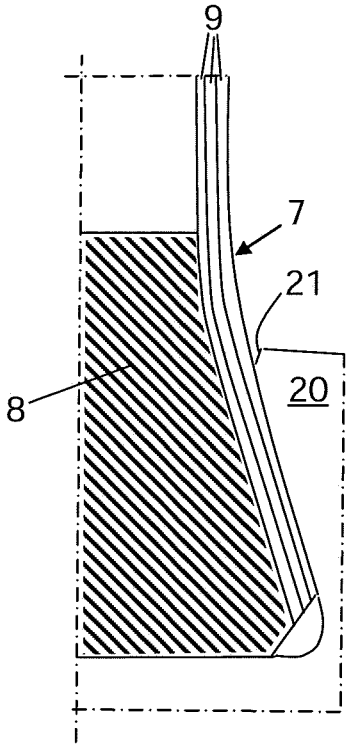
FIGS. 5 through 7 show different embodiments of diverging walls of the root.

With reference to the figures, these show a blade 1 comprising an airfoil 2 and a root 3. The blade 1 can be manufactured in one piece in ceramic matrix composite material CMC (this is the preferred solution).

The airfoil 2 has a tip 4 and the root 3 has a free end 5.

The root 3 has diverging walls 7; e.g. FIGS. 1-9 shows an embodiment of a root with only one couple of diverging walls; FIG. 10 shows an example of a root with two couples of diverging walls; in different examples the number of couples of diverging walls can anyhow be any.

The diverging walls 7 are made of a ceramic matrix composite material CMC and a reinforcement element 8 is provided between the diverging walls 7.

The diverging walls 7 can be made in one layer or preferably in a plurality of layers 9. This is advantageous in particular for diverging walls 7 of large thickness; in addition a plurality of layers 9 for the diverging walls 7 improves load distribution among the layers 9. An embodiment with diverging walls 7 having a plurality of layers 9 is e.g. shown in FIGS. 4 and 5.

The diverging walls can also be provided with intermediate layers 11, made of a material different from the ceramic matrix composite material and provided between the layers 9 of ceramic matrix composite material; the intermediate layers 11 can be made of the same material as the reinforcement element 8.

Figure 6:
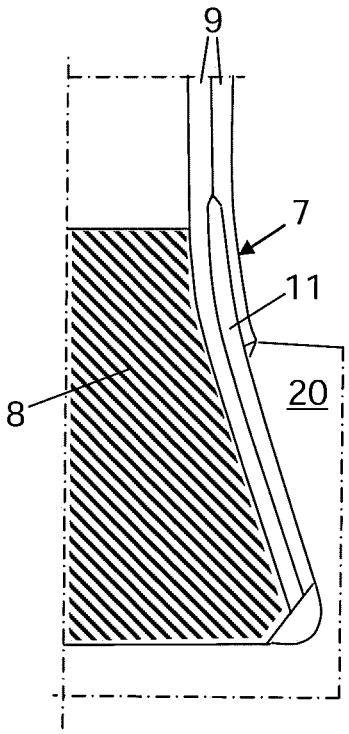
Figure 7:
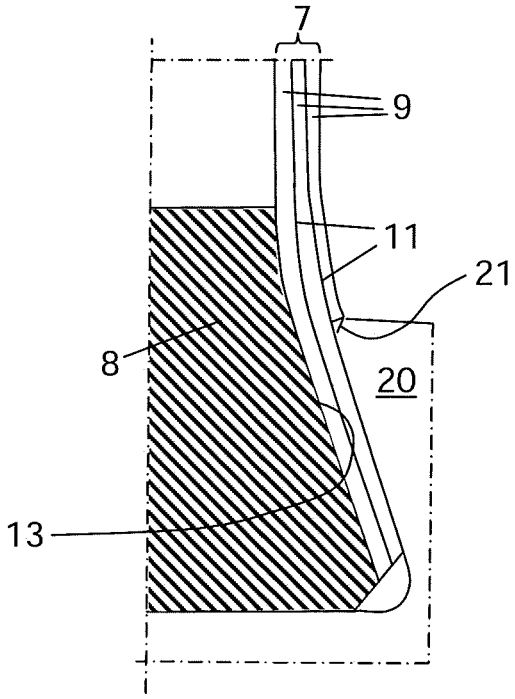

The intermediate layer or layers 11 can extend only substantially in correspondence of the root 3, as shown in FIG. 6, or can also extend in correspondence of part or all the airfoil 3, as shown in FIG. 7.

The reinforcement element 8 can be made from metal or other material; use of metal over other materials such as composite materials like CMC is advantageous because manufacturing is easy and the material (metal) can be chosen according to the needs as for strengths, weight, etc.; in addition, since the reinforcement element 8 is only confined at the root or possibly only extends in the airfoil for a limited portion thereof, the centrifugal forces caused by the reinforcement element 8 are limited and within acceptable limits for the blade.

The attached figures show the reinforcement element 8 with diverging walls 13; the diverging walls 7 of the root rest on the diverging walls 13 of the reinforcement element 8.

In different embodiments the reinforcement element 8 can be defined only by the diverging walls 13 with a connecting member interposed between them, or it can be defined by a massive element having the diverging walls 13 (this embodiments is shown in the attached figures).

Figure 8:
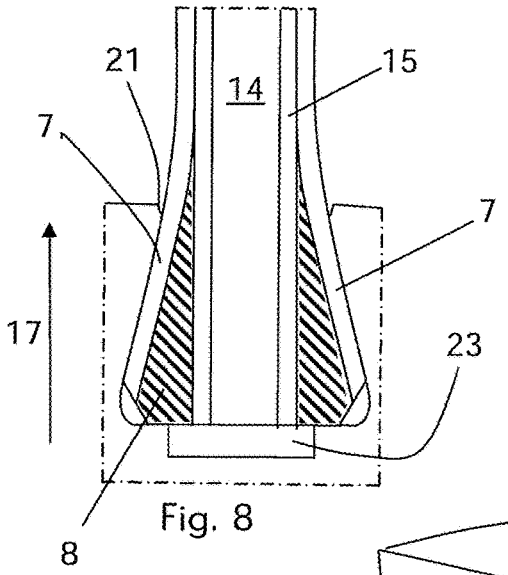
FIGS. 8 through 10 show a root with a cooling passage.
Figure 9:
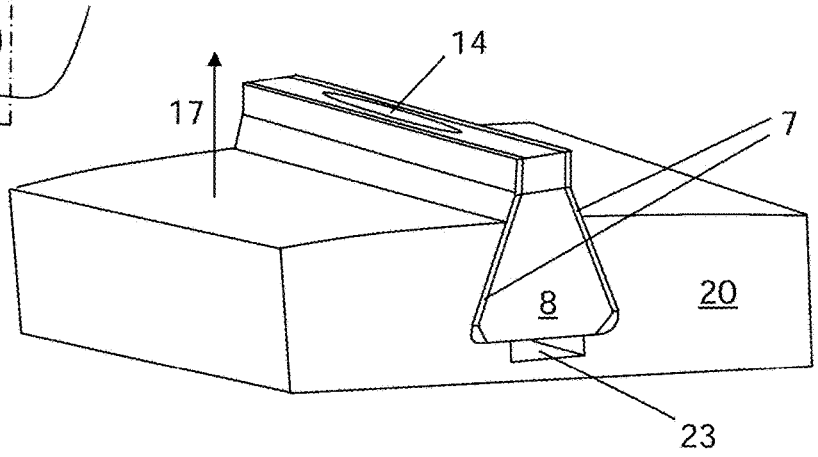
Figure 10:
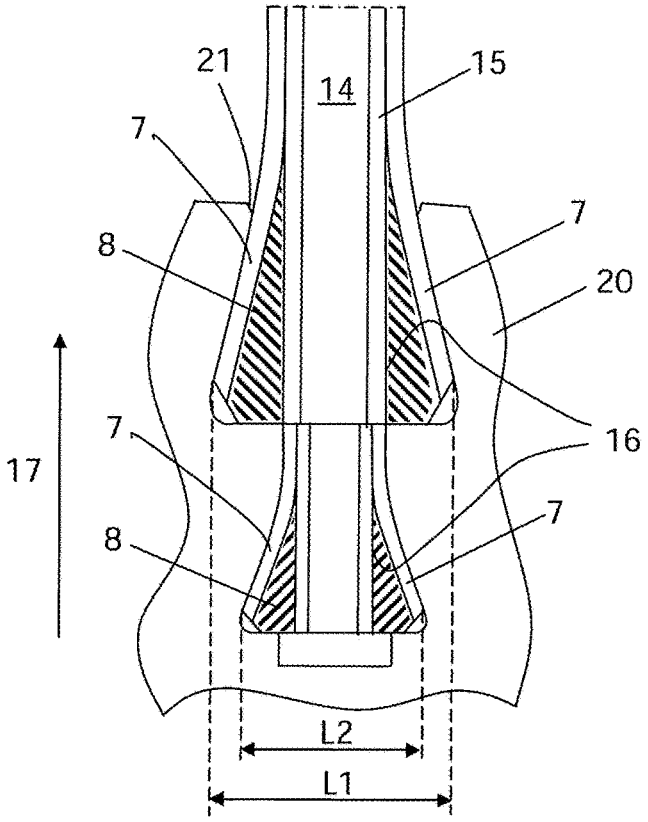

FIGS. 8-10 show embodiments of the reinforcement element 8 provided with one or more cooling passages 14.

In this case, a tubular element 15 made of ceramic matrix composite material CMC or metal is preferably provided in the cooling passage 14, with the side surface of the tubular element 15 resting on the side surface of the cooling passage 14 or not. The tubular element can at least partially carry the load, in particular the centrifugal load.

The cooling passage can have any cross section, e.g. round, oval, square, rectangular, triangular, etc.; likewise, the tubular element can have any cross section, e.g. round, oval, square, rectangular, triangular, etc.

Reference 16 indicates the side surface of the tubular element 15 and the side surface of the cooling passage 14 resting one against the other.

The cooling passage 14 extends substantially in the direction 17 of the airfoil 2.

In this case a duct 23 for cooling air circulation can be provided between the rotor 20 and the blade 1.

A sacrificial layer 18 can be provided on the diverging walls 7; the sacrificial layer 18 can extend over the whole surface of the diverging walls or only a part thereof. The sacrificial layer 18 is arrange to be damaged in place of the diverging walls 7 and/or rotor 20 during operation; for example the sacrificial layer 18 can be made of metal being the same or also different from the metal of the reinforcement element 8. Other materials are naturally possible for the sacrificial layer 18.

In addition a bounding layer 19 can be provided between the diverging walls 7 and the reinforcement element 8, in order to promote reciprocal adhesion. For example the bounding layer can be a glue layer.

FIG. 10 shows an embodiment of the blade 1 having the root 3 with two couples of diverging walls 7. In particular, FIG. 10 shows that diverging walls 7 closer to the airfoil 2 have a larger width L1 in cross section than the width L2 of the diverging walls 7 farther from the airfoil 2.

The blade 1 is preferably a long blade, such as a blade of a downstream stage of a gas turbine, e.g. third, fourth or subsequent stage. The blade can thus have a longitudinal length between the root free end 5 and the airfoil tip 4 of at least 0.8 m and preferably 1 m and more preferably 1.15 m. In a preferred embodiment the blade 1 has a longitudinal length between 1.15-1.25 m.

During operation, the blade 1 is connected to the rotor 20. The seat of the rotor 20 housing the root 3 advantageously has tapering 21 at its borders, to reduce stress concentration at the blade 1.

During operation the rotor 20 rotates, causing rotation of the blades as well. The centrifugal forces push the blades radially outwards and the diverging portions 7 retain the blades 1; this causes a compression (as indicated by arrows P) of the diverging walls 7 with the risk of collapse. The reinforcing element 8 interposed between the diverging walls 7 supports the diverging walls 7 and counteracts the collapse.

Naturally the features described may be independently provided from one another. For example, the features of each of the attached claims can be applied independently of the features of the other claims.

In practice the materials used and the dimensions can be chosen at will according to requirements and to the state of the art.

REFERENCE NUMBERS

1 blade
2 airfoil
3 root
4 tip
5 free end
7 diverging walls of the root 3
8 reinforcement element
9 layers
11 intermediate layers
13 diverging walls of the reinforcing element 8
14 cooling passage
15 tubular element
16 side surfaces
17 direction of the airfoil
18 sacrificial layer
19 bonding layer
20 rotor
21 tapering
23 duct
L1 width
L2 width
P compression

The invention claimed is:

1. A blade comprising:
an airfoil;
a root, the root having diverging walls, the diverging walls being made of a ceramic matrix composite material;
a reinforcement element between the diverging walls, wherein the reinforcement element is a metal element and the reinforcement element is provided with at least one cooling passage; and
a tubular element made of ceramic matrix composite material, wherein the tubular element is inserted in the cooling passage, and a side surface of the tubular element rests on a side surface of the cooling passage.

2. The blade of claim 1, wherein the diverging walls are made in a plurality of layers.

3. The blade of claim 2, comprising:
an intermediate layer made of a material different from the ceramic matrix composite material, between at least two layers of the plurality of layers of ceramic matrix composite material.

4. The blade of claim 3, wherein the intermediate layer extends at least partly in the airfoil.

5. The blade of claim 1, wherein the reinforcement element has reinforcement element diverging walls, and the diverging walls of the root rest on the reinforcement element diverging walls.

6. The blade of claim 1, wherein the at least one cooling passage extends substantially in a direction of the airfoil.

7. The blade of claim 1, comprising:
a sacrificial layer on at least a part of the diverging walls.

8. The blade of claim 1, wherein the root comprises:
at least two couples of diverging walls.

9. The blade of claim 8, wherein diverging walls of a first couple of diverging walls of the at least two couple of diverging walls, that is proximate to the airfoil, has a larger width in cross section than a second couple of diverging walls of the at least two couple of diverging walls, that is distal to the airfoil.

10. The blade of claim 1, wherein the airfoil is made of ceramic matrix composite material.

11. The blade of claim 1, wherein the blade has a longitudinal length between a root free end and an airfoil tip of at least 0.8 m.

12. The blade of claim 1, wherein the blade has a longitudinal length between a root free end and an airfoil tip of at least 1 m.

13. The blade of claim 1, wherein the blade has a longitudinal length between a root free end and an airfoil tip of at least 1.15 m.

14. The blade of claim 1, wherein the blade has a longitudinal length between a root free end and an airfoil tip of at least between 1.15-1.25 m.

15. The blade of claim 1, wherein the reinforcement element is a metal element.

* * * * *